US006682048B2

(12) United States Patent
Weber

(10) Patent No.: US 6,682,048 B2
(45) Date of Patent: Jan. 27, 2004

(54) NAIL PULLING CAM

(76) Inventor: Dennis Weber, P.O. Box 1491, Wisconsin Rapids, WI (US) 54494

( * ) Notice: Subject to any disclaimer, the term of this patent is extended or adjusted under 35 U.S.C. 154(b) by 0 days.

(21) Appl. No.: 10/157,712

(22) Filed: May 30, 2002

(65) Prior Publication Data

US 2003/0222251 A1 Dec. 4, 2003

(51) Int. Cl.[7] ..... B66F 1/00
(52) U.S. Cl. ..... 254/1; 254/26 R
(58) Field of Search ..... 254/26 R, 25, 254/17, 164, 1; 144/195.5, 195.9; 12/115.6, 117.2, 103, 116.8, 133 R, 141

(56) References Cited

U.S. PATENT DOCUMENTS 830,072 A * 9/1906 Houlihan
1,485,863 A * 3/1924 McLain
2,449,861 A * 9/1948 Renner ..... 12/115.6
4,260,135 A * 4/1981 Dickey
4,993,429 A * 2/1991 Krinsky ..... 12/142 N
5,230,115 A * 7/1993 Hollister et al. ..... 12/115.6

* cited by examiner

*Primary Examiner*—Robert C. Watson
(74) *Attorney, Agent, or Firm*—Russell L. Johnson

(57) ABSTRACT

A cam that when positioned next to a nail which is engaged with the claw of a claw hammer will keep the prying fulcrum of the hammer at the level of the head of the nail as the hammer rotates along the cam and pulls the nail upward with a force directed along the axis of the nail. The cam is provided with a handle that serves as an aid in positioning the cam and also an aid to placing the cam in and removing the cam from a craftsman's personal carrier. The handle also can serve as a straight edge, a scale, a scribing guide, a pry, and a tack and brad pulling aid. The handle and the cam together can serve as a square. The cam can be provided with a slot which a partially pulled nail can enter so that the hammer can regain a mechanical advantage and to press against the work surface and protect it from damage from the nail being pulled from the work surface.

2 Claims, 2 Drawing Sheets

PRIOR ART
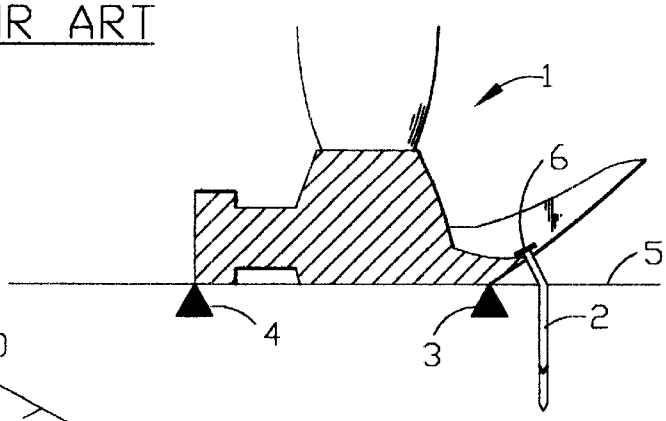
FIG. 1
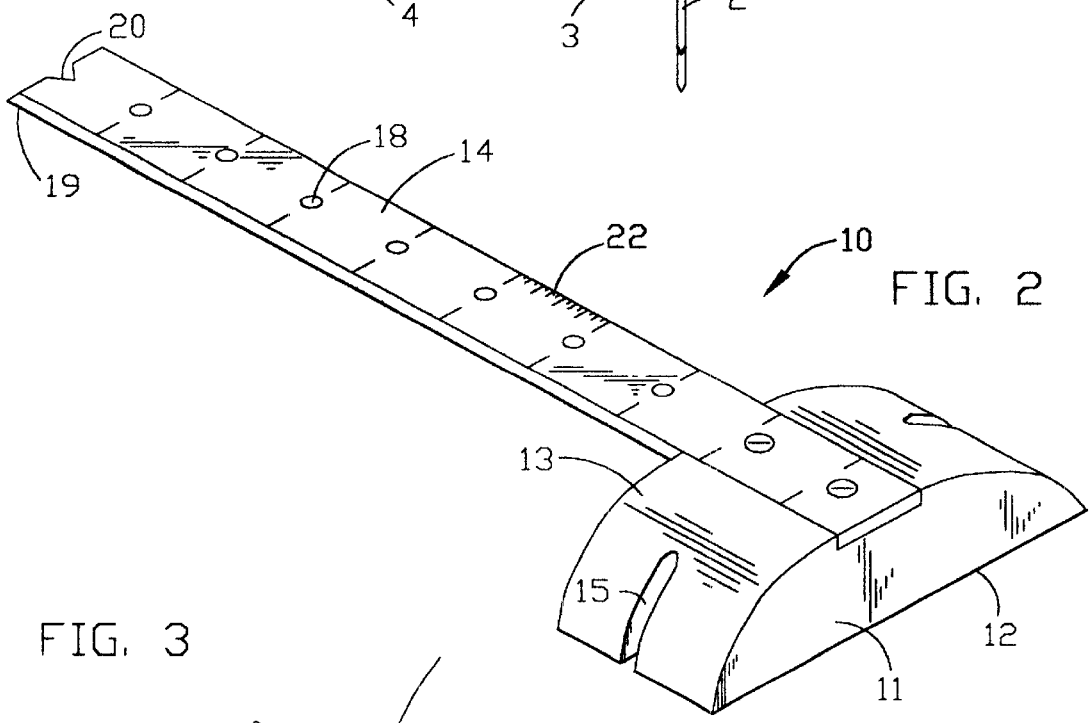
FIG. 2
FIG. 3
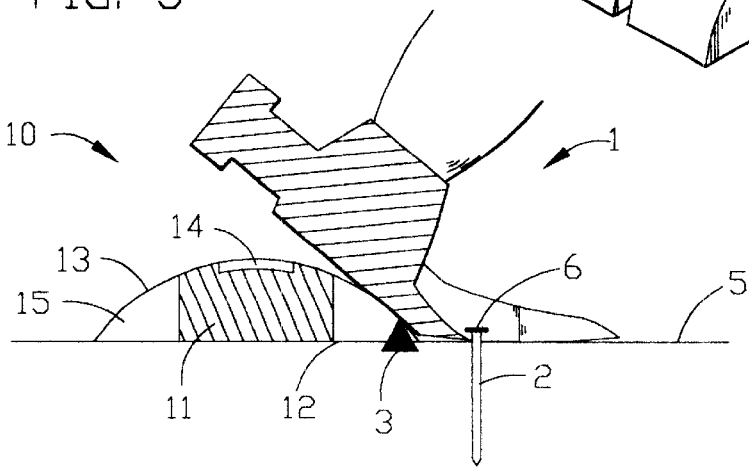

FIG. 4
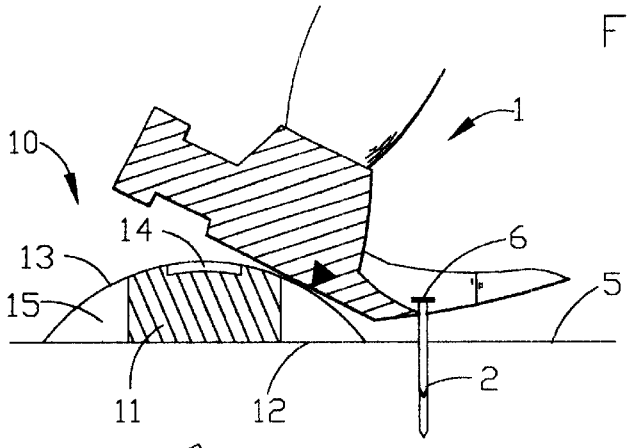
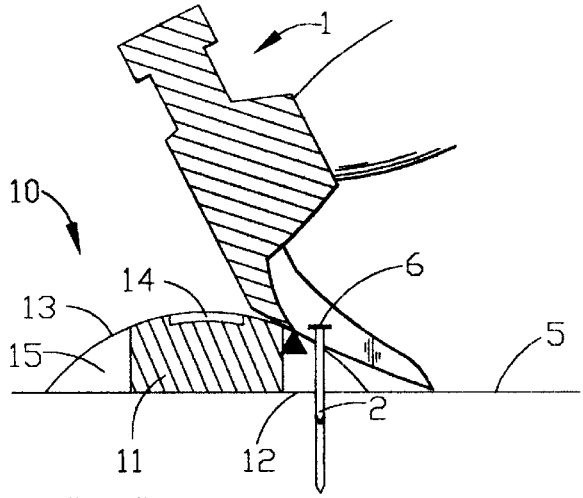
FIG. 5
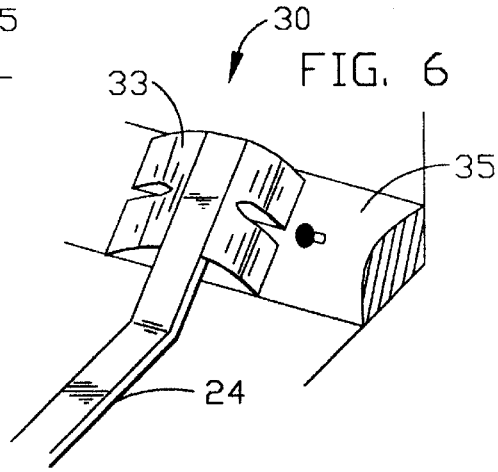
FIG. 6
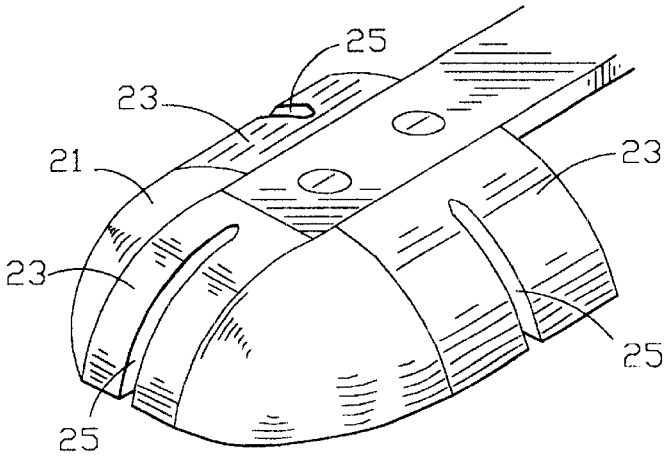
FIG. 7
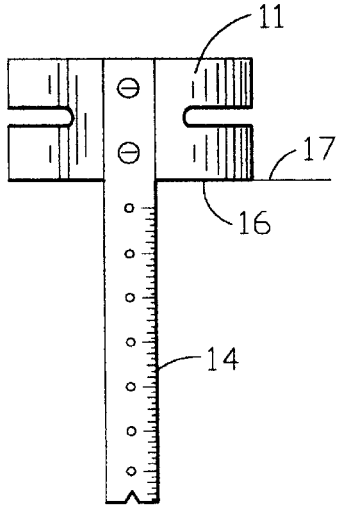
FIG. 8

NAIL PULLING CAM

BACKGROUND OF THE INVENTION

This invention relates to cams for use with prying and pulling tools.

More specifically, this invention relates to cams as described above wherein the cam serves to provide a prying or pulling tool, with a moving pivot point that serves to enable the tool to pry or pull in a substantially straight line.

More specifically this invention relates to a cam for use with claw hammers and pry bars to enable the pulling and prying to be accomplished in substantially a straight line.

When pulling a nail or other fastener by means of a claw hammer or a crow bar or other nail pulling or prying means it is advantageous to use a prying means that has a fulcrum near to the pulling or prying point and a long handle for the user to apply a significant mechanical advantage. This mechanical configuration results in the prying or pulling arm of the lever moving through an arc having a short radius while the handle or effort arm rotates through an arc of large radius.

When the fulcrum or pivot point lies along a line perpendicular to the desired direction of pull, the rotation of the prying or pulling means causes the prying or pulling point to rotate upward and towards the fulcrum. When pulling nails from boards this results in the bending of the nail and the elongation of the nail hole.

When prying boards away from a surface or when pulling nails, it is desirable to do so with a pull that is straight and in line with the long axis of the nail or other fastener.

Heretofore, carpenters and other workers who have occasion to pry or pull fasteners out of engagement with a structure have employed a small block of wood or other means to raise the location of the pivot above the level of the object being pried or pulled so that rotation of the pulling or prying point was away from the fulcrum initially and towards the fulcrum as the rotation of the prying or pulling point was moved to a location above the pivot point. The result was a pull or pry that is closer to a straight pry or pull along the long axis of the fastener being pulled or pried than would have occurred had the alternate fulcrum not been used.

The holding of the block or fulcrum in place presents problems when working on a vertical or overhead surface. The availability of a suitable fulcrum close at hand in these work locations also presents problems.

It is an object of this invention to provide a cam that provides a fulcrum that moves upward as the pull or pry progresses.

It is further an object of this invention to provide the cam described above with a handle to facilitate positioning and repositioning the cam and for carrying the cam on a belt or a loop on the workman's clothing.

It is further an object of this invention to provide the cam as described above wherein the cam and handle combination can serve multiple additional utilities.

DESCRIPTION OF THE RELATED ART

The patent art contains numerous examples of means for achieving an approximately straight pull on a fastener.

U.S. Pat. No. 4,260,135 to Dickey teaches a tool rest made from neoprene rubber that protects the work surface from damage while affording a moving pivot for a claw hammer to remove a fastener in an approximate straight line perpendicular to the work surface.

U.S. Pat. No. 1,485,863 to McLain teaches a ramped fulcrum attached to a tool for pulling railroad spikes from ties in an approximately straight pull vertical to the tie.

U.S. Pat. No. 830,072 to Houlihan teaches a nail extractor that attaches to a claw hammer and provides a moving fulcrum to provide the greatest leverage when the nail is fully imbedded.

It can be seen from this prior art that the art has been aware of a need to apply a pulling force along the axis of a fastener to be pulled from a work surface and to protect the surface from marring in the process.

While the prior art can be seen to recognize some of the problems solved by this invention and to offer partial solutions to those specific problems, the art cannot be said to anticipate the instant invention or to suggest it to one skilled in the art.

BRIEF DESCRIPTION OF THE INVENTION

A nail-pulling cam having a planer base and a convexly curved upper surface and a handle extending from the curved upper surface.

BRIEF DESCRIPTION OF THE DRAWINGS

FIG. 1 is a sectioned elevation view of a prior art method of pulling nails.

FIG. 2 is a pictorial view of the cam of this invention.

FIG. 3 is a sectioned elevation view of the cam of this invention preparatory to pulling a nail.

FIG. 4 is a view of the cam of FIG. 3 wherein the fulcrum for pulling the nail has moved upward as the nail is pulled.

FIG. 5 is a view of the cam of FIG. 3 wherein the cam has been repositioned to reclaim mechanical advantage and protect the work surface.

FIG. 6 is a pictorial view of the cam of this invention as it is used to pull nails driven at an angle.

FIG. 7 is a pictorial view of the cam of this invention wherein the cam is provided with multiple slots.

FIG. 8 is a plan view of the cam of FIG. 1, as it would be used as a square.

DETAILED DESCRIPTION OF THE INVENTION

The term "cylinder" as used herein shall be read to mean, "a three dimensional shape with straight parallel sides and circular or oval cross section" (Concise Oxford Dictionary).

The term "element" as used herein shall be read to mean, "the generator of a geometric figure, also, a line or line segment contained in the surface of a cone or cylinder (Webster's Collegiate Dictionary).

The term "dome" as used herein shall be read to mean, "the rounded vault forming a roof of a building or structure.> the revolving openable hemispherical roof of an observatory" (Concise Oxford Dictionary).

Referring now to FIG. 1 wherein the prior art method of employing a claw hammer 1 to pull a nail 2 is shown. Triangle 3 indicates the location of the fulcrum on hammer 1 when nail 2 is first being pulled from work surface 5. Pull point 6 is the point where the claw of hammer 1 engages nail 2. FIG. 1 illustrates that as hammer 1 pivots about the fulcrum at triangle 3, pull point 6 rotates up and towards hammer 1 bending nail 2 and elongating the nail hole surrounding nail 2. Continued rotation of hammer 1 will shift the fulcrum to a location indicated by triangle 4 and rotate pull point 6 through a greater arc than was present when rotating about the fulcrum at triangle 3. The result is a bent nail, an elongated nail hole and often times a splinter dislodged from the surface of the board from which the nail is being pulled.

It is known practice to employ a block of wood to raise the fulcrum above the pull point so that the nail 2 is bent first away from hammer 1 and then towards hammer 1 resulting in less bending on nail 2 and less distortion and damage to the nail hole surrounding nail 2.

These methods work well for rough work. However, when it is desirable to limit the damage to the piece from which the nail is being removed, a means for pulling the nail along its long axis and protecting the surface of the piece is desired.

Referring now to FIGS. 2 through 5 wherein a preferred embodiment of the nail pulling cam 10 of this invention is shown. Cam 10 is shown to comprise body 11, having a planer base 12, convexly curved upper cam surface 13, and a handle 14, extending from the curved upper cam surface 13.

In FIG. 2, body 11 is shown to define a slot 15, which is perpendicular to base 12, and projects inward from the perimeter of base 12. FIGS. 3, 4 and 5 illustrate the utility of slot 15. The curvature of cam surface 13 is such that the fulcrum about which hammer 1 is rotating at any time in the pulling of nail 2 lies on a line perpendicular to the long axis of nail 2 and intersects nail 2 at pull point 6. The result is that the pull on nail 2 is always along the long axis of nail 2 throughout the pull of nail 2. However, the fulcrum is moving upward and away from nail 2 as hammer 1 is rotated thereby reducing the mechanical advantage to the handle in pulling nail 2. Slot 15 serves to permit the regaining of the mechanical advantage to the handle of hammer 1 as illustrated in FIG. 5 while at the same time moving planer base 12 over the work surface surrounding nail 2. When doing restoration work wherein antique molding and trim is of great value and it is desirable to exercise great care in removing it for restoration, the capability to protect the work surface 5 surrounding nail 2 is critical.

As shown in FIG. 5, cam body 11 is advanced towards nail 2 so that slot 15 overlays the work surface surrounding nail 2 and presses it downward in response to the load transmitted from hammer 2 at the fulcrum, thereby greatly reducing the potential for distorting or splintering work surface 5 around the location from which nail 2 is extracted.

Craftsmen and workers in the construction trades, while on the job are moving about the job site and often in locations where it is impractical for them to carry a tool kit with them. It is inefficient for them to stop working and go to their tool kit for a tool. It is customary to carry utilitarian tools on their person in aprons, pouches, and in pockets or on hangers. In order for a tool to find a place in a craftsman's personal carrier, the tool must first be utilitarian and second be readily put into and extracted from the craftsman's personal carrier. The tool of this invention meets both of these requirements.

The cam of this invention can serve a number of functions that a craftsman is called on to perform besides the primary function of an assist in applying an axial pull to a nail. As shown in FIG. 8, the cam of this invention can serve as a square. Handle 14 is perpendicular to first end surface 16 of body 11 so that when first end surface 16 of body 11 is positioned adjacent to a straight edge 17 of a work piece, handle 14 is at right angles to the work piece. As shown in FIG. 2, handle 14 is provided with indicia 22 so that handle 14 can serve as a scale and a straight edge. Handle 14 further defines bores 18 whose axes are perpendicular to base 12, at regular intervals so that cam 10 can serve as a scribe guide. As shown in FIG. 2, the end of handle 14 is shaped into an edge 19 so that handle 14 can serve as a pry. Edge 19 is provided with a notch 20 so that handle 14 can serve as a brad, staple and tack puller.

The above disclosures are enabling so that one skilled in the art could employ the underlying concepts of this invention without undue experimentation. The invention admits of variants that are within the scope of the underlying concepts and the appended claims.

For example, The cam disclosed in FIG. 1 is cylindrical in that transverse elements of the curved upper cam surface 13 has elements that are parallel to the planer base and parallel to each other. Cam surface 13 provides a curved surface such that the moving fulcrum moves along parallel lines thereby providing for an even pull on hammer 1. As shown in FIG. 7, body 21 may have a generally dome shape and can be provided with a multiplicity of slots 25 having associated cylindrical cam surfaces 23. The cam of FIG. 7 is particularly useful in cooperation with a pry being moved along under a long strip of molding or trim.

As a second example, cam 30 of FIG. 6 is provided with a bent handle 24. This embodiment of the invention is particularly useful in removing molding and trim that is nailed at an angle to a floor or wall. For example: the handle is bent at an angle of 45 degrees to the elements of a cylinder for pulling nail's that are driven into trim at 45 degrees to a floor and wall. In use handle 24 is positioned along a wall or floor adjacent to the molding and cam 30 is positioned so that it will afford a cam surface 33 that will permit the pulling of nails holding molding 35 along the long axis of the nails.

It should be understood that the scope of the instant invention should not be limited to the embodiments and variants disclosed but that the scope of the instant invention should only be limited by the scope of the appended claims and all equivalents thereto that would be made apparent thereby to one skilled in the art.

What is claimed is:

1. A nail pulling cam comprising;

a body having a planer base and a convexly curved upper cam surface, and a handle extending outward from the curved upper cam surface, and wherein the curved upper surface is cylindrical in shape and elements of the cylinder are parallel to the base.

2. The nail pulling cam of claim 1 wherein the free end of the handle is rounded to an edge and wherein the edge is provided with a tack-pulling notch.

* * * * *